United States Patent [19]

Takagi et al.

[11] 4,173,731

[45] Nov. 6, 1979

[54] RESISTOR COMPOSITION FOR SPARK PLUG HAVING A RESISTOR ENCLOSED THEREIN

[75] Inventors: Shunichi Takagi; Masaru Fukuoka, both of Aichi, Japan

[73] Assignee: NGK Spark Plug Co., Ltd., Nagoya, Japan

[21] Appl. No.: 883,084

[22] Filed: Mar. 2, 1978

[30] Foreign Application Priority Data

Mar. 2, 1977 [JP] Japan ..... 52-22305

[51] Int. Cl.[2] ..... H01J 7/44; H01J 17/34; H01J 23/16; H01K 1/62

[52] U.S. Cl. ..... 315/58; 252/504; 252/505; 252/506; 252/507; 252/508; 252/509

[58] Field of Search ..... 252/504, 505, 506, 507, 252/508, 509; 315/58

[56] References Cited

U.S. PATENT DOCUMENTS 3,567,658 3/1971 Webb et al. ..... 252/506
3,903,453 9/1975 Nishio ..... 315/58
4,004,183 1/1977 Oki et al. ..... 315/58

*Primary Examiner*—Benjamin R. Padgett
*Assistant Examiner*—E. Suzanne Parr
*Attorney, Agent, or Firm*—Sughrue, Rothwell, Mion, Zinn and Macpeak

[57] ABSTRACT

A resistor composition for use in producing a resistor used in a spark plug comprising (1) 100 parts by weight of
  (a) a glass; and
  (b) an inorganic filler;
    with the glass (a) being present in a proportion of about 30 to about 70% by weight and the inorganic filler (b) being present in a proportion of about 70% to about 30% by weight;
    and wherein at least about 0.1% by weight of the inorganic filler (b) is replaced by at least one non-oxide compound;

(2) about 0.5 to about 7 parts by weight of carbon; and (3) 0 to about 20 parts by weight of at least one of a metal oxide, a transition metal carbide, SiC having a low electrical resistivity and $B_4C$.

16 Claims, 5 Drawing Figures

RESISTOR COMPOSITION FOR SPARK PLUG HAVING A RESISTOR ENCLOSED THEREIN

BACKGROUND OF THE INVENTION

1. Field of the Invention

The present invention is concerned with a resistor composition for a spark plug having a resistor sealed therein.

2. Description of the Prior Art

It is well known that a spark plug having a resistance value of 0.5 to 20 KΩ sealed in an electrode bore of a porcelain insulator of the spark plug which comprises placing an electrically conductive glass between a center electrode and a terminal electrode, both electrodes being placed face-to-face with respect to each other in the electrode bore, prevents noise as well as the generation of an interfering electric wave upon sparking.

These resistors are generally produced from a resistor composition comprising a glass, which is necessary for sealing, containing carbon or metal oxides, metal carbides and metals, etc. as an electrically conductive material, and, as necessary, inorganic fillers such as alumina, zircon, zirconia, silica, mullite, and clays, etc.

After various investigations on glasses, electrically conductive materials and inorganic fillers which are used to produce these resistors and on the influences thereof upon efficiency, the present invention has been achieved, particularly using inorganic fillers which have not been used heretofore.

SUMMARY OF THE INVENTION

In one embodiment of this invention, the invention provides a resistor composition for a resistor useful in a spark plug, the resistor composition comprising (1) 100 parts by weight of
  (a) a glass; and
  (b) an inorganic filler;
    with the glass (a) being present in a proportion of about 30 to about 70% by weight and the inorganic filler (b) being present in a proportion of about 70% to about 30% by weight;
    and wherein at least about 0.1% by weight of the inorganic filler (b) is replaced by at least one non-oxide compound;

(2) about 0.5 to about 7 parts by weight of carbon; and (3) 0 to about 20 parts by weight of at least one of a metal oxide, a transition metal carbide, SiC having a low electrical resistivity and $B_4C$.

In another embodiment of this invention, the invention provides a spark plug including a center electrode;

a terminal electrode;

an electrically conductive glass positioned between the center electrode and the terminal electrode; and a resistor separating the electrically conductive glass between the center electrode and the terminal electrode wherein the center electrode and the terminal electrode are placed face-to-face in an electrode bore of a porcelain insulator of the spark plug and sealed therein;

with the resistor comprising a resistor produced from a resistor composition comprising (1) 100 parts by weight of
  (a) a glass; and
  (b) an inorganic filler;
    with the glass (a) being present in a proportion of about 30 to about 70% by weight and the inorganic filler (b) being present in a proportion of about 70% to about 30% by weight;
    and wherein at least about 0.1% by weight of the inorganic filler (b) is replaced by at least one non-oxide compound;

(2) about 0.5 to about 7 parts by weight of carbon; and (3) 0 to about 20 parts by weight of at least one of a metal oxide, a transition metal carbide, SiC having a low electrical resistivity and $B_4C$.

BRIEF DESCRIPTION OF THE DRAWINGS

FIG. 2 is a graph showing results of measuring field strength noise;

FIG. 3 is a graph showing results of measuring capacity discharge current;

FIG. 4 is a graph showing the change in rate of resistivity in a sparking duration test with heating; and FIG. 5 is a graph showing the relationship between the $Si_3N_4$ content in the inorganic filler and the change in rate of resistivity; in which A represents a conventional spark plug and B represents a spark plug in accordance with the present invention.

DETAILED DESCRIPTION OF THE INVENTION

Figure 1:
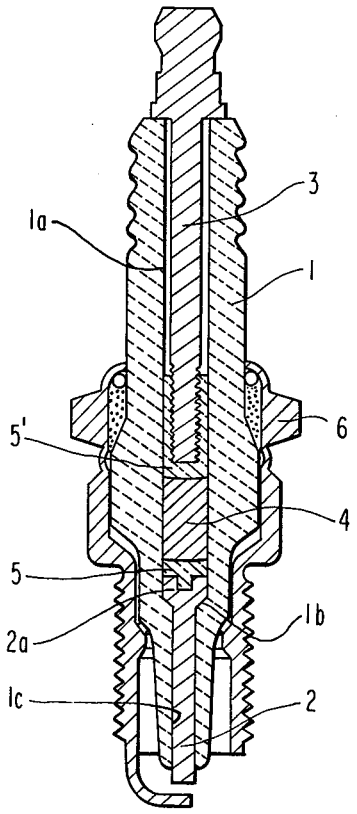
FIG. 1 is a cross sectional view of a typical spark plug having a resistor sealed therein, wherein 1 is a porcelain insulator, 1*a* is a electrode bore, 1*b* is a seat, 1*c* is a terminal bore of electrode bore 1*a*, 2 is a center electrode, 2*a* is a flange, 3 is a terminal, 4 is a resistor, 5,5′ are electrically conductive glasses and 6 is a metal fitting.

The characteristic feature of the present invention resides in a resistor in which an electrically insulating material, such as non-oxides including $Si_3N_4$, AlN, BN, etc., is employed in part or as all of the inorganic filler contained in the resistor composition which comprises glasses, inorganic fillers and carbon. It was found that the resistor of this invention possesses highly efficient characteristics as compared to conventional resistors mainly composed of inorganic fillers. That is, the resistor in accordance with the present invention is excellent in preventing noise due to an electric wave emitted from the high electric voltage ignition circuit of an internal-combustion engine, and exhibits extremely stable resistor characteristics in continuous use for sparking as a resistor, the so-called load life characteristic.

Suitable non-oxides which can be used in this invention are those having covalent bond characteristics and a specific resistivity of at least about $10^5$ Ω.cm at about 20° C. to about 300° C., preferably $10^5$ to $10^{13}$ Ω.cm at about 20° C. to above 300° C.

Preferred examples of non-oxides which can be employed in accordance with the present invention are nitrides such as $Si_3N_4$, AlN, BN, $Si_2ON_2$ and mixtures thereof, borides such as AlB, etc., silicides such as $\beta$-$FeSi_2$, SiC (having a high resistance value) etc., which have a large specific resistance. A suitable composition ratio thereof is, about 30 to about 70 wt% of a glass and about 70 to about 30 wt% of an inorganic filler which can be alumina, zircon, zirconia, silica, mullite, clays and the like or mixtures thereof. Further, at least about 0.1 wt% of the inorganic filler content is replaced by one of the above-described non-oxides and based on 100 parts by weight of the glass and the inorganic filler mixture about 0.5 to about 7 parts by weight of carbon black or of carbon arising after carbonization of water soluble carbonaceous materials such as glycerin, methyl cellulose, etc. and about 0 to about 20 parts by weight of at least one material selected from the group consisting of metal oxides such as $TiO_2$, $Nb_2O_5$, $Ta_2O_5$, $ThO_2$ and $La_2O_3$, etc., carbides of transition metals such as TiC, NbC, TaC, WC, LaC and the like, as well as $B_4C$ and SiC (having a lower resistance value) as an element for stabilizing the resistivity can also be present. A suitable particle size for the components of the resistor composition of this invention is about 1000μ or less, preferably 200μ or less.

The reason for the restriction of a glass to 30 to 70 wt% and the balance to an inorganic filler or a non-oxide is as follows. If the amount of glass is smaller than about 30 wt%, the softening point of the resistor composition is high and as a result, the insertion of the terminal shaft under pressure can be performed only with difficulty so that the density of the resistor becomes non-uniform. If the amount of glass exceeds about 70 wt%, the softening point conversely is low and upon the insertion of the terminal shaft under pressure, the upper surface of the resistor is distorted in a concave shape to result in the effective length of the resistor not being constant.

The aim in substituting at least about 0.1 wt% of the non-oxides into the inorganic filler such as alumina and the like is because the substitution of at least about 0.1 wt% of the non-oxides is effective in stabilizing the resistor, i.e., sparking durability, which is an object of the present invention. Of course, it has been empirically confirmed that the stability increases as the amount of non-oxides added increases. Further, for improving the noise prevention effect which is another object of the present invention, the greater the amount of non-oxides substituted, the better the effect in prevention of noise.

Furthermore, the stability of the resistivity increases as the amount of the above-described non-oxides substituted increases. Therefore, it is preferred for the amount of the oxides of transition metals, carbides, and the like added to be small, for example, less than about 20 parts by weight in order to maintain better stability, although the presence of these oxides, carbides and the like is optional.

Next, it can be seen with reference to the examples given below that the resistor composition of the present invention has a stable load life property, has excellent sparking durability, and exhibits useful noise prevention properties.

In producing a resistor from the resistor composition of this invention, a mixture of particles or powders of the above described components is prepared, and then the mixuture heated. The heating temperature will be dependent upon the softening point of the glass employed but will generally range from about 800° C. to about 1000° C., preferably 900° to 950° C. A suitable pressure during the heating ranges from about 10 to 12 $kg/cm^2$.

Turning now to the figures, FIG. 1 represents a sample spark plug having a sealed resistance therein which was used in the examples. Investigations were conducted with a spark plug sample produced by inserting center electrode 2 comprising a Ni alloy, equipped with flange 2*a*, into terminal bore 1*c* of electrode bore 1*a* (bore diameter; 4.7 mmϕ) of a highly aluminous porcelain insulator 1 which was divided with seat 1*b*, filling with first an electrically conductive glass powder 5 on flange 2*a* of center electrode 2 in this electrode bore 1*a* and further filling with a resistor composition 4 and second electrically conductive glass powders 5' additionally on the first filled glass powders, which was followed by heating the resulting porcelain insulator sample at a definite temperature e.g., about 900° to 950° C., to thereby soften the electrically conductive glasses 5 and 5' as well as the resistor composition 4, thereafter pressing terminal electrode 3 therein to thereby uniformly seal under pressure so that a resistor having a resistor length of 7 mm and a resistivity of about 5 KΩ was enclosed, metal fitting 6 mainly composed of a 14 mm type install screw being combined therewith.

The following examples are given to illustrate the present invention in greater detail.

EXAMPLE 1

Figure 2:
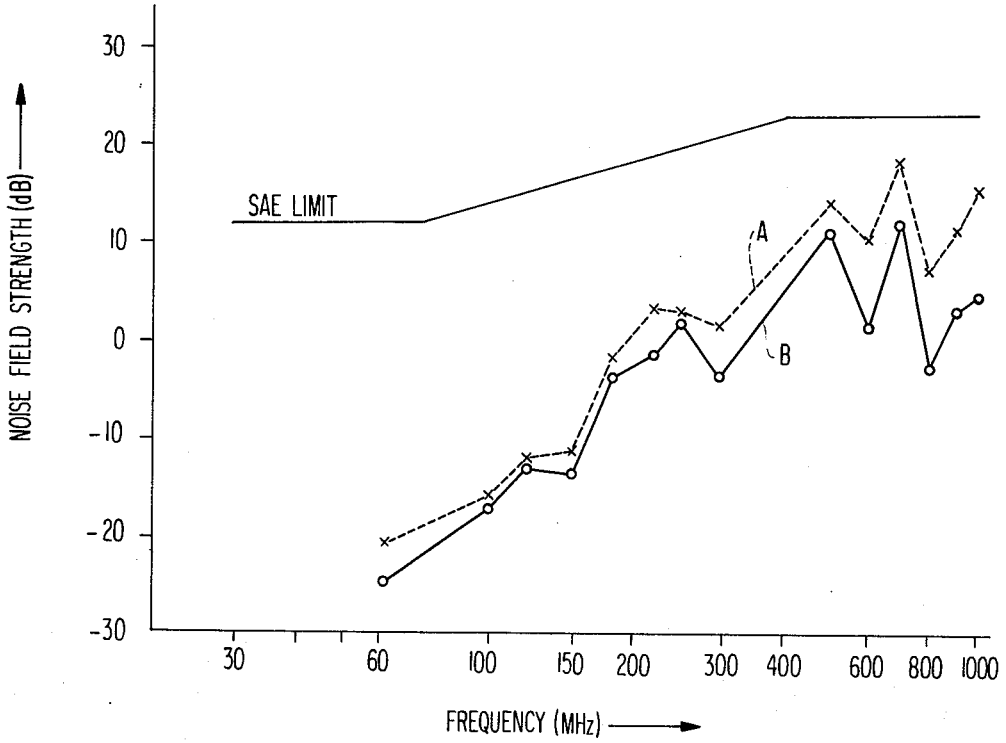
FIGS. 2 through 5 are graphical presentations of the experimental results obtained relative to the present invention.
Figure 3:
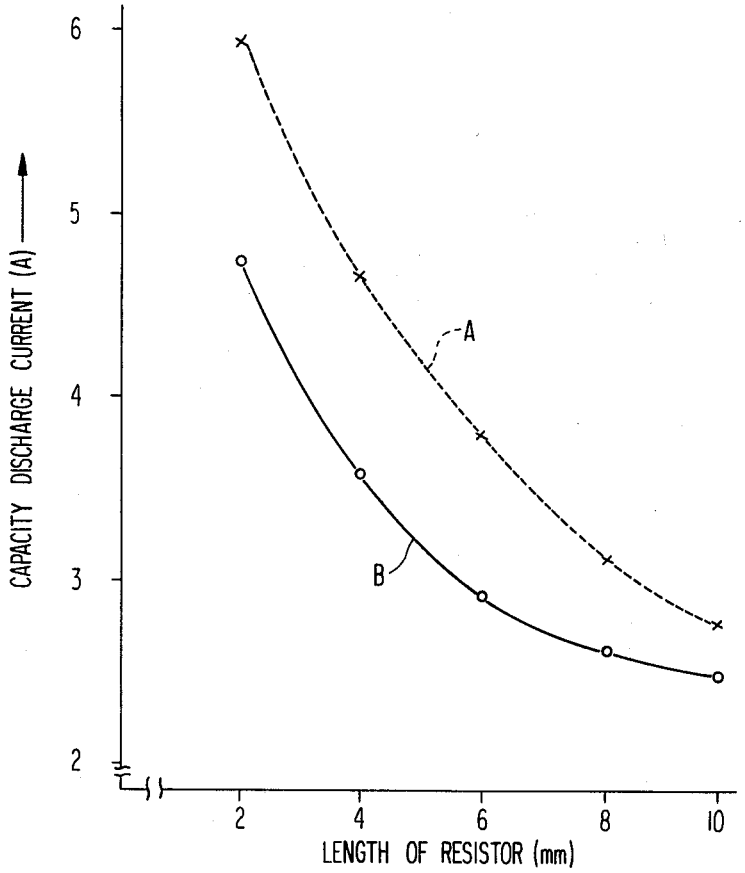

FIG. 2 and FIG. 3 demonstrate that the spark plug equipped with the resistor in accordance with the present invention is effective for preventing electric wave noise upon spark discharge.

Here, conventional spark plug A was used for comparison. The resistor employed therein used oxides and inorganic fillers for the electrically insulating materials and was obtained by adding 50 parts by weight of a mixture of zircon (having a particle size of about 100μ or less) and clay (having a particle size of about 5μ or less) as an inorganic filler to 50 parts by weight of borosilicate glass powders (having a particle size of about 100μ or less) further adding thereto 1 part by weight of carbon (obtained by calcination-carbonizing glycerin as a water-soluble carbonaceous material) so as to have an electric resistivity of about 5 KΩ in the spark plug sample shown in FIG. 1, and further adding about 10 parts by weight of $TiO_2$ or $Nb_2O_5$ (having a particle size such that 50% of the particles were about 5μ or less) thereto, followed by mixing sufficiently and graining in a wet condition or dry condition.

On the other hand, spark plug B using the resistor in accordance with the present invention was obtained by sealing uniformly, putting an electrically conductive glass between a porcelain insulator sample in a similar manner to spark plug A above with the exception that non-oxide $Si_3N_4$ powders (having a particle size of about 150μ or less) were substituted for all of the inorganic filler of the resistor composition employed for spark plug A and was otherwise the same.

FIG. 2 shows the results obtained by measuring the field strength of noise with a 4-cycle 360 cc engine based on the SAE Standard. As is clear from the results in FIG. 2, the noise level of spark plug B of the present invention which contained $Si_3N_4$ was decreased over almost all frequencies as compared to conventional spark plug A and the spark plug of the present invention was effective for preventing noise.

FIG. 3 shows the results obtained by measuring the capacity discharge current which flows through the resistor upon spark discharge, by changing the inorganic filler amount of the resistors and by changing the resistor length after sealing with heating under pressure to 2, 4, 6, 8 and 10 mm, both in conventional spark plug A and spark plug B of the present invention. The electrical resistivity enclosed is about 5 KΩ in both of the spark plugs.

It can be seen from the results in FIG. 3 that the extent of noise due to an electric wave emitted from a high voltage ignition circuit is approximately dependent upon the degree of the capacity discharge current which flows through the resistor and by determining this electric current, the efficiency of the resistor itself for preventing noise is predictable. As is seen from FIG. 3, the peak electric current of the spark plug in accordance with the present invention is considerably decreased as compared to that of conventional spark plug A and it is understood that spark plug B containing the resistor of this invention is effective for preventing noise.

The reason for this is believed because the resistor of the present invention containing non-oxides, which do not act as an electrically conductive material but exhibit an electrically insulating property, provides poor wetting property to glass between particles as compared to oxide type inorganic fillers so that the resistor is rendered porous, the effective impedance is increased since electro-static capacity is decreased, and thus this would function effectively for preventing noise. Therefore, the noise preventing effect was more improved as the amount of the non-oxides added was increased and the graininess of the non-oxides became finer.

EXAMPLE 2

Figure 4:
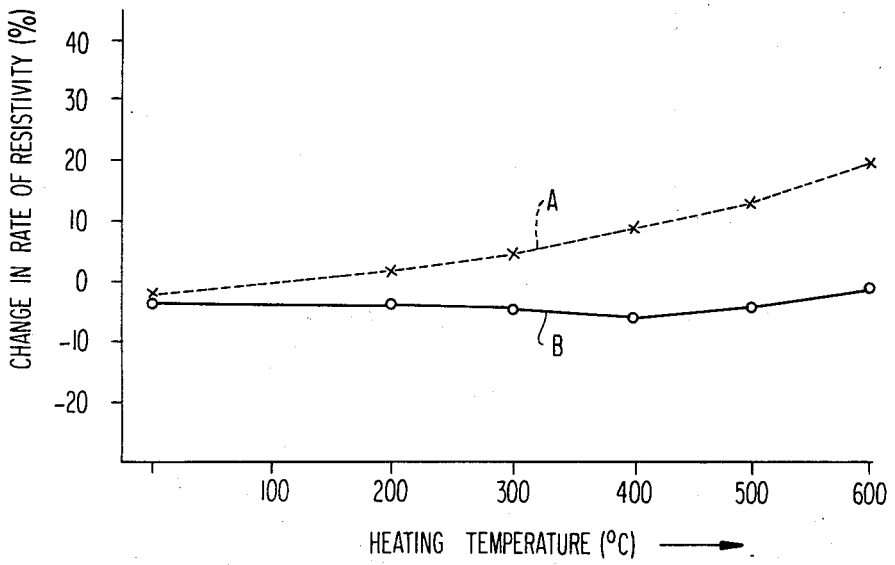
Figure 5:
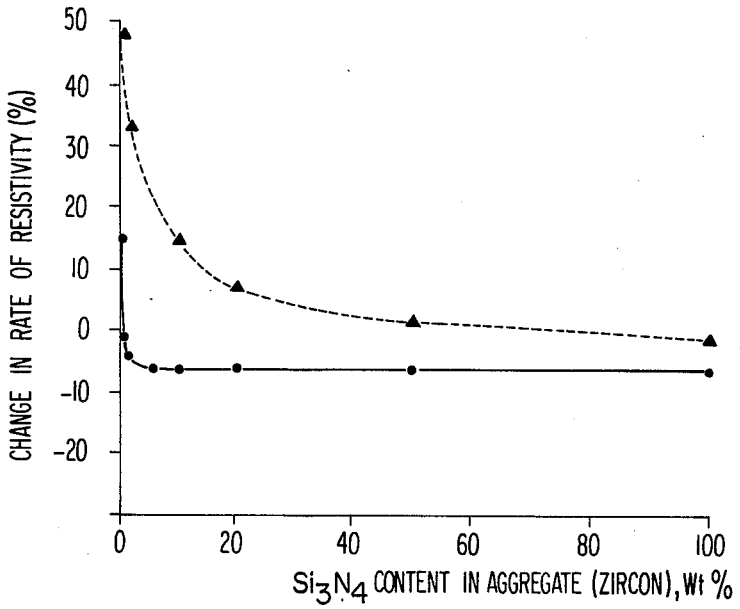

Next, FIG. 4 and FIG. 5 show the results obtained when the resistor is subjected to continuous use for sparking, and that the resistor in accordance with this invention has a stable load life property which is another characteristic feature of the resistor in accordance with the present invention.

FIG. 4 shows the change in rate of electrical resistivity when conventional spark plug A and spark plug B of the present invention described in Example 1 were subjected to spark duration testing at various definite temperatures from normal temperature (e.g., about 20° C.) to 600° C. for 100 hrs. The change in rate was determined by initially measuring the electrical resistivity between the center electrode and the terminal electrode at normal temperature and subsequently measuring the resistivity after testing at a definite temperature for a definite period of time followed by allowing the spark plug to stand for 30 mins. at normal temperature. The values illustrated in FIG. 4 are averaged values of five test samples.

These resistors in spark plugs must be stable in temperature/continuous use and spark/continuous use. However, it is actually impossible for the electrical resistivity to not change at all. In general, it is preferred for the electrical resistivity after use to be slightly smaller than that before use. Based on this, it can be seen from the results in FIG. 4 that spark plug B of the present invention is more stable than conventional spark plug A.

Further, FIG. 5 shows experimental results indicating the stability of the electrical resistivity increases as the inorganic filler in the resistor is replaced by non-oxides. The solid line in FIG. 5 represents the results obtained when the spark plug was obtained by enclosing the resistor (which was obtained by substituting $Si_3N_4$ for zircon in the resistor composition of conventional spark plug A described in Example 1, otherwise the samples were identical) in the spark plug sample shown in FIG. 1 and subjecting such to spark duration testing in a furnace at 400° C. for 100 hrs. The dotted line in FIG. 5 represents the results obtained using a resistor in which $Si_3N_4$ was substituted for zircon in a similar manner, but in this case, no $TiO_2$ as a component for stabilizing the resistivity was employed.

As can be seen from the results in FIG. 5, when no $Si_3N_4$ was added (zircon inorganic filler alone), the change in rate of electrical resistivity was positive, after spark duration testing, but the change in rate became negative with the addition of $Si_3N_4$ and stabilized. Further, the effect due to addition of $TiO_2$ was also substantial. Where $TiO_2$ was added, it was necessary to substitute at least 0.1 wt% of $Si_3N_4$, but in samples where no $TiO_2$ was added, it was necessary to substitute about 50 wt% of $Si_3N_4$.

In the examples, zircon was used as a representative inorganic filler but with any of alumina, mullite, silica, zirconia, kaolin clay and the like, a similar tendency was observed although some variation was observed.

In the description of the present invention, $Si_3N_4$ powders were employed as a representative example of the non-oxides, but similar effects were obtained also with AlN and BN powders. The reason for this stabilization is believed to be because the incorporation of the non-oxides functions to prevent oxidation of the carbon which is formed by oxygen remaining in the resistor.

The stability of the electrical resistivity in the present invention is slightly different depending on the kind of carbon present. The stability of that obtained when water-soluble carbonaceous materials such as glycerin, methyl cellulose, etc. were carbonized was better than when carbon black was employed. Further, $TiO_2$ or $Nb_2O_5$ was employed herein as a representative example of components for stabilizing the electrical resistivity. However, similar effects were obtained where metal oxides of metals selected from transition metals, such as $Ta_2O_5$, $ThO_2$, $La_2O_5$, etc., or metal carbides such as TiC, NbC, TaC, WC, LaC, etc., as well as carbides such as $B_4C$ or SiC were used.

While the invention has been described in detail and with reference to specific embodiments thereof, it will be apparent to one skilled in the art that various changes and modifications can be made therein without departing from the spirit and scope thereof.

What is claimed is:

1. A resistor composition for producing a resistor for a spark plug comprising
   (1) 100 parts by weight of
      (a) a glass;
      (b) an inorganic filler selected from the group consisting of alumina, zircon, zirconia, silica, mullite, a clay or a mixture thereof;
         with the glass (a) being present in a proportion of about 30 to about 70% by weight and the inorganic filler (b) being present in a proportion of about 70% to about 30% by weight;
         and wherein at least about 0.1% by weight of the inorganic filler (b) is replaced by at least one non-oxide compound having covalent bond characteristics and a specific resistivity of at least about $10^5$ Ωcm at about 20° C. to about 300° C.;
   (2) about 0.5 to about 7 parts by weight of carbon; and
   (3) 0 to about 20 parts by weight of at least one of a metal oxide, a transition metal carbide, SiC having a low electrical resistivity and $B_4C$.

2. The resistor composition as claimed in claim 1, wherein said non-oxide compound is a nitride, a boride or a silicide.

3. The resistor composition as claimed in claim 2, wherein said non-oxide compound is a nitride selected from the group consisting of $Si_3N_4$, AlN, BN and $Si_2ON_2$, or a mixture thereof.

4. The resistor composition as claimed in claim 2, wherein said non-oxide compound is AlB.

5. The resistor composition as claimed in claim 2, wherein said non-oxide compound is $\beta$-$FeSi_2$ or SiC having a high electrical resistivity.

6. The resistor composition as claimed in claim 1, wherein said carbon is carbon black or carbon produced by carbonization during resistor production.

7. The resistor composition as claimed in claim 1, wherein said metal oxide is $TiO_2$, $Nb_2O_5$, $Ta_2O_5$, $ThO_2$, $La_2O_3$ or a mixture thereof and wherein said transition metal carbide is TiC, NbC, TaC, WC, LaC or a mixture thereof.

8. The resistor composition as claimed in claim 1, wherein said non-oxide compound $\beta$-$FeSi_2$.

9. In a spark plug having a resistor sealed therein and including a center electrode, a terminal electrode, an electrically conductive glass positioned between the center electrode and the terminal electrode, and a resistor separating the electrically conductive glass between the center electrode and the terminal electrode, wherein the center electrode and the terminal electrode are placed in a face-to-face relationship in an electrode bore of a porcelain insulator of the spark plug and sealed therein, the improvement which comprises said resistor being produced from a resistor composition comprising (1) 100 parts by weight of
  (a) a glass; and
  (b) an inorganic filler selected from the group consisting of alumina, zircon, zirconia, silica, mullite, a clay or a mixture thereof;
  with the glass (a) being present in a proportion of about 30 to about 70% by weight and the inorganic filler (b) being present in a proportion of about 70% to about 30% by weight; and wherein at least about 0.1% by weight of the inorganic filler (b) is replaced by at least one non-oxide compound having covalent bond characteristics and a specific resistivity of at least about $10^5$ Ωcm at about 20° C. to about 300° C.;

(2) about 0.5 to about 7 parts by weight of carbon; and (3) 0 to about 20 parts by weight of at least one of a metal oxide, a transition metal carbide, SiC having a low electrical resistivity and $B_4C$.

10. The spark plug as claimed in claim 9, wherein said non-oxide compound is a nitride, a boride or a silicide.

11. The spark plug as claimed in claim 10, wherein said non-oxide compound is a nitride selected from the group consisting of $Si_3N_4$, AlN, BN and $Si_2ON_2$, or a mixture thereof.

12. The spark plug as claimed in claim 10, wherein said non-oxide compound is AlB.

13. The spark plug as claimed in claim 10, wherein said non-oxide compound is $\beta$-$FeSi_2$ or SiC having a high electrical resistivity.

14. The spark plug as claimed in claim 9, wherein said non-oxide compound is $\beta$-$FeSi_2$.

15. The spark plug as claimed in claim 9, wherein said carbon is carbon black or carbon produced by carbonization during resistor production.

16. The spark plug as claimed in claim 9, wherein said metal oxide is $TiO_2$, $Nb_2O_5$, $Ta_2O_5$, $ThO_2$, $La_2O_3$ or a mixture thereof, wherein said transition metal carbide is TiC, NbC, TaC, WC, LaC or a mixture thereof.

* * * * *